US006150947A

United States Patent [19]

Shima

[11] Patent Number: 6,150,947

[45] Date of Patent: Nov. 21, 2000

[54] PROGRAMMABLE MOTION-SENSITIVE SOUND EFFECTS DEVICE

[76] Inventor: James Michael Shima, 173 Mohawk Cir., Superior, Colo. 80027

[21] Appl. No.: 09/391,791

[22] Filed: Sep. 8, 1999

[51] Int. Cl.[7] ..... G08B 25/08

[52] U.S. Cl. ..... 340/692; 84/609; 446/175

[58] Field of Search ..... 340/692, 669, 340/670, 671, 686.1, 689, 691.3, 539, 384.1, 384.5, 384.6, 384.7; 446/175; 84/609

[56] References Cited

U.S. PATENT DOCUMENTS

| | | | |
|---|---|---|---|
| 4,160,339 | 7/1979 | Dankman et al. | 46/227 |
| 4,627,324 | 12/1986 | Zwosta . | |
| 4,678,450 | 7/1987 | Scolari et al. . | |
| 4,737,134 | 4/1988 | Rumsey | 446/409 |
| 4,904,222 | 2/1990 | Gastgeb et al. . | |
| 5,040,319 | 8/1991 | Wang et al. | 40/414 |
| 5,130,693 | 7/1992 | Gigandet . | |
| 5,145,446 | 9/1992 | Kuo . | |
| 5,195,920 | 3/1993 | Collier | 446/409 |
| 5,351,436 | 10/1994 | Spalding et al. . | |
| 5,484,316 | 1/1996 | Poirier . | |
| 5,647,787 | 7/1997 | Raviv et al. | 446/175 |
| 5,648,753 | 7/1997 | Martin . | |
| 5,920,024 | 7/1999 | Moore | 84/609 |
| 5,984,810 | 11/1999 | Frye et al. | 473/455 |

*Primary Examiner*—Jeffery A. Hofsass
*Assistant Examiner*—Daniel Previl
*Attorney, Agent, or Firm*—Watts, Hoffmann, Fisher & Heinke, Co., L.P.A.

[57] ABSTRACT

A programmable sound effects device which utilizes a motion-sensitive mechanism for selecting unique sound effects. The device is comprised of an electronic motion-sensitive actuator, a sound effect storage media for storing a plurality of predetermined sound effects, and a playback mechanism for audibly emitting the motion-activated sound effects. This device is designed to be used with amusement and entertainment type products such as toys, games, dolls, and props, with exemplary uses in toy swords, drumsticks, magic wands, and the like. A preferred embodiment is comprised of a unit which is physically incorporated into the handle of a toy sword. As the user moves the toy sword in a predefined manner, the motion-sensitive actuator senses the motion and plays out a plurality of unique sound effects as a function of the user's movements. The motion-detection algorithm which triggers the different sound effects is programmable. In another embodiment, the device is contained within a single housing unit that is worn on the user's body. This embodiment is well suited for many toys, props, games, and the like that do not have any sound effects capability but would benefit from such capability.

20 Claims, 6 Drawing Sheets

Playback
115
Speaker
111
Amplifier
113
Power Supply
112
Accelerometer
122
Signal Processor
121
210
DSP
212
DAC
211
CLK
Boot EPROM
120
Storage
123 Motion-Sensitive Actuator
124
S1

PROGRAMMABLE MOTION-SENSITIVE SOUND EFFECTS DEVICE

BACKGROUND—FIELD OF INVENTION

This invention relates to sound effects devices, and more particularly to a progammable sound effects device that is capable of producing interactive sound effects based on motion.

BACKGROUND—DESCRIPTION OF PRIOR ART

There are a plethora of sound effect devices that are incorporated into toys, dolls, games and the like. Typically, these sound effects devices add some amusement quality to the toy, but they do not give the user a true interactive. environment in which to play. Particularly, toys that offer some synchronized sound effects that are directly related to the motion of the toy or the user's own body creates a more realistic play environment.

There exist several proposals that address different designs for sound effects devices. For example, an interchangeable, wrist-worn sound effects device that can be used with a myriad of existing toys. The wrist-worn device is to be used with new or existing toys that do not have sound effects capabilities and to give the user a broader play environment by utilizing different sound effects. However, the user would need to locate and press buttons residing on a wrist band in order to play the different sound effects. So, the added realism of play when using this device is questionable since the user must continually press separate buttons for each sound effect the user would like to hear at a particular instance in time. A synchronized sound device to be used in a toy sword has also been proposed. The toy sword would be waved about, which in turn would produce an oscillatory electrical signal to trigger a sound generator synchronized with the flexing of the toy sword. The oscillating sound effects would be produced via a piezoelectric effect from a transducer attached to the sword blade. This proposal does offer some synchronization of sound with waving the sword about, however, the sound generated from the transducer would be simplistic and this device does not give the user the freedom to play specific sounds corresponding to specific movements. Furthermore, the proposal was for a fixed design which could not be reprogrammed to handle different types of motion and play different sound effects.

The prior art does not address a programmable sound effects device which can be designed into new toys and also used with existing toys, provide high-quality, interactive sound effects based on the user's own motion, and provide specific sound effects for specific types of movements. It would be desirable to have a sound effects device with the flexibility of activating sound effects for different types of motion which include, but not limited to, waving, striking, jabbing, and the like. Another desirable property of such a sound effects device would be the capability of being programmable and thereby able to recognize different types of motion which initiate each sound effect. Thus, the toy would play preprogrammed, individual, and unique sound effects that correspond to the toy being waved up or down, striking another object, swung over the head, shaken vigorously, and the like.

SUMMARY

This device comprises, in accordance with the present invention, a programmable motion-sensitive sound effects device comprising a motion-sensitive actuator, a sound effect storage means, and a playback means.

OBJECTS AND ADVANTAGES

The primary object of the invention is to provide a motion-sensitive device that allows the user to generate interactive, realistic sound effects based on and corresponding to the user's movement.

Another object of the invention is to generate high-quality, motion-related sound effects that allow the user to perceive a more realistic and natural environment.

A further object of the invention is to provide a device that allows the user to correlate specific movements with realistic sound effects during play without having to stop play.

Yet another object of the invention is to provide a device that allows the user to correlate specific movements with realistic sound effects during play without having to provide user intervention unrelated to play in order to generate the sound effect.

Still another object of the invention is to provide a plurality of motion-sensitive sound effects by using a programmable storage media, with each media storing a unique set of sound effects.

Another object of the invention is to provide a plurality of motion-sensitive sound effect applications by using a programming media, with each media storing a unique set of program instructions.

Another object of the invention is to provide a device that contains programming means to generate interactive sound effects based on different types of movement.

Yet another object of the invention is to provide a device that can be designed into a manufacturer's existing line of toys, dolls, books, and the like that lack the capability of producing interactive sound effects.

Still another object of the invention is to provide a device that can be designed into a manufacturer's line of new toys, dolls, books, and the like to include the capability of producing interactive, motion-based sound effects.

A further object of the invention is to provide a device that allows the user to play with any toy, doll, book, or the like and add interactive sound effects when there existed no sound effects previously.

Another object of the invention is to provide a cost effective device since only one device is needed for a plurality of sound effects.

Another object of the invention is to provide a cost effective device since only one device is needed for a plurality of motion-based sound effects applications.

Yet another object of the invention is to provide a device that is lightweight and small enough to be physically incorporated into a toy, doll, game, or the like.

A further object of the invention is to provide a device that is lightweight and small enough to be physically worn by the user.

Still yet another object of the invention is to provide a device that is portable and can be powered by a small, replaceable power source.

Other objects and advantages of the present invention will become apparent from the following descriptions, taken in connection with the accompanying drawings, wherein, by way of illustration and example, an embodiment of the present invention is disclosed.

DRAWING FIGURES

Figure 2:
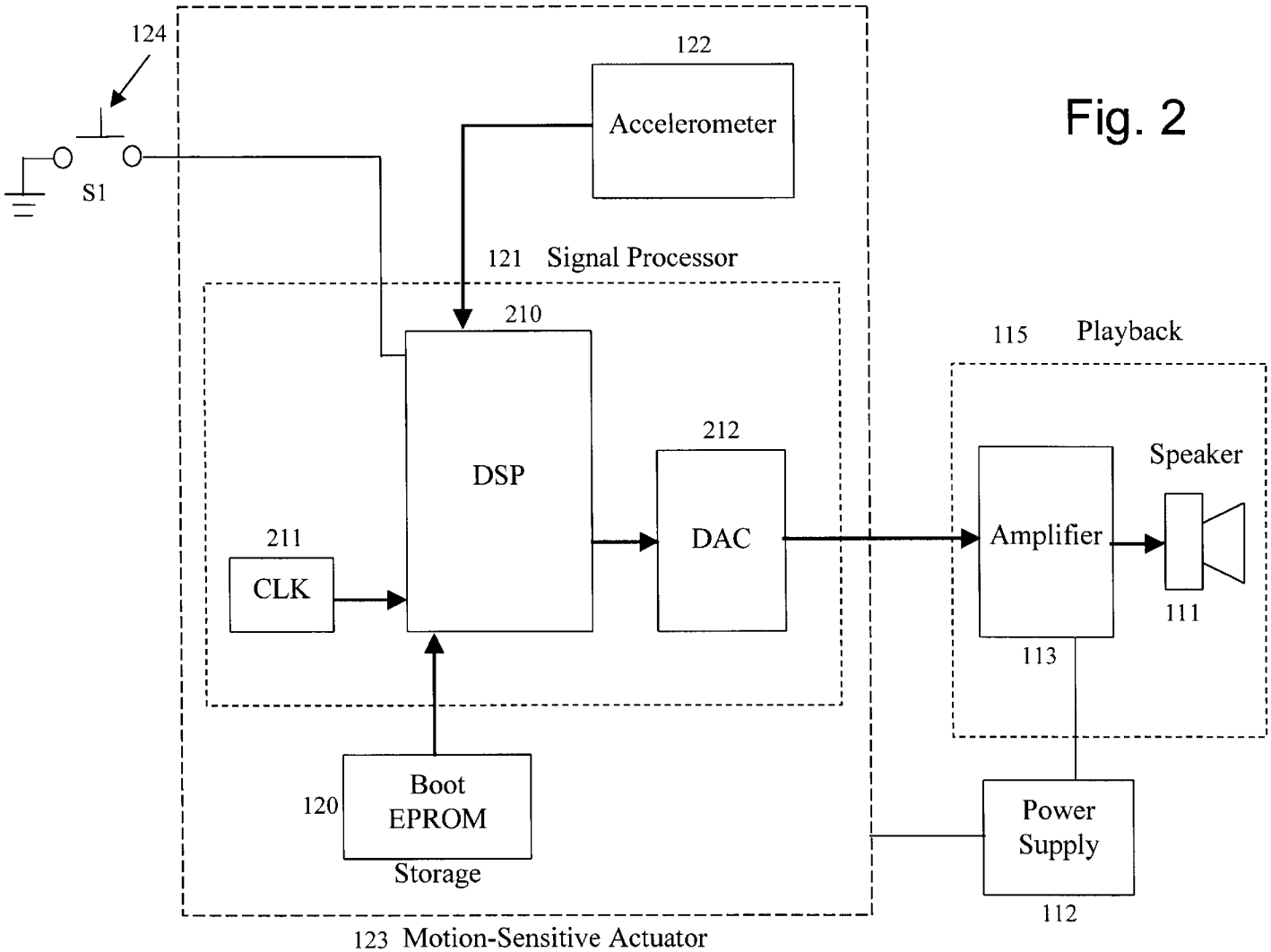
FIG. 2 is a basic block diagram showing the components comprising the first embodiment of FIG. 1.
Figure 3:
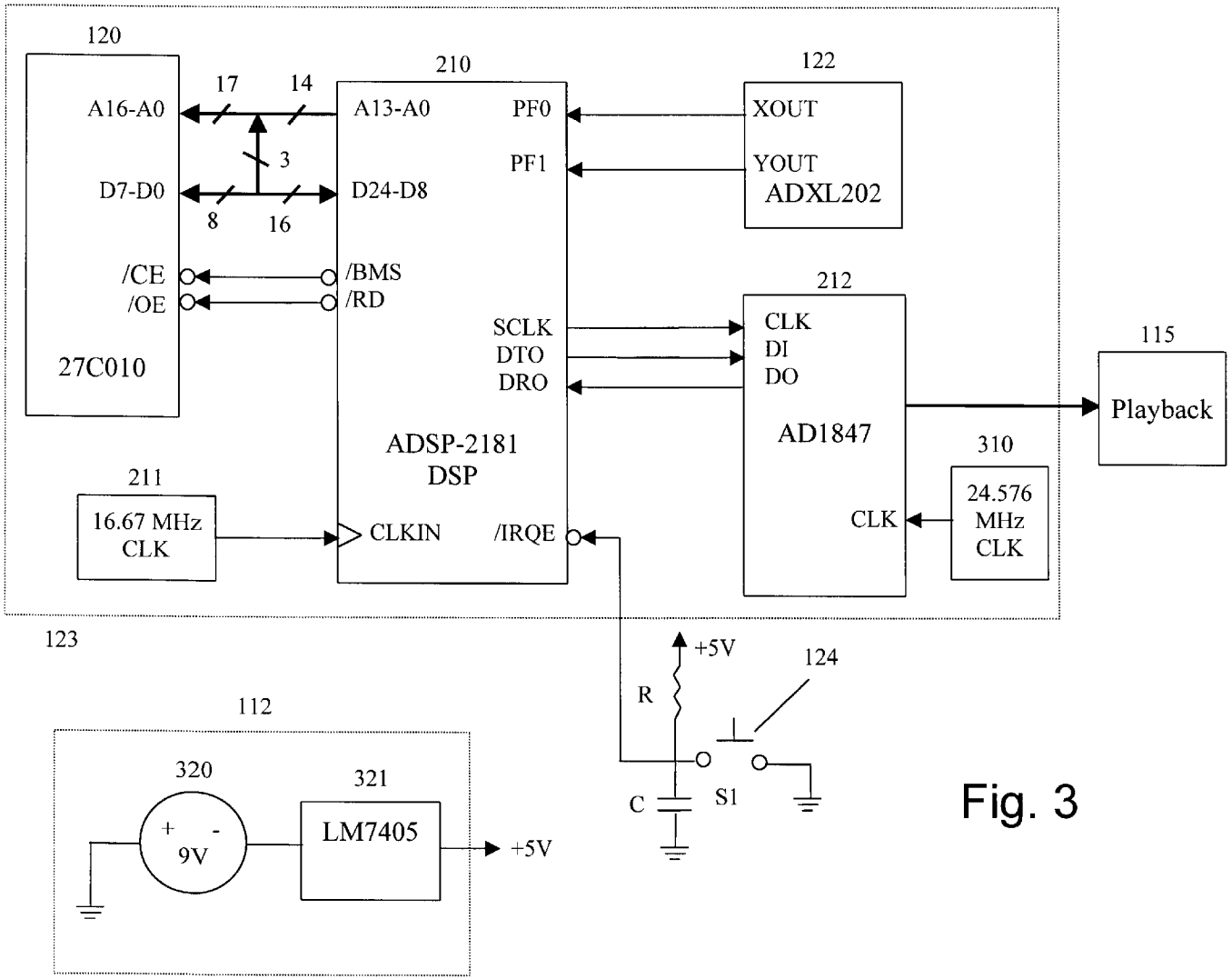

FIG. 3. is a more detailed schematic block diagram showing the basic circuitry employed in FIG. 2.

Figure 4:
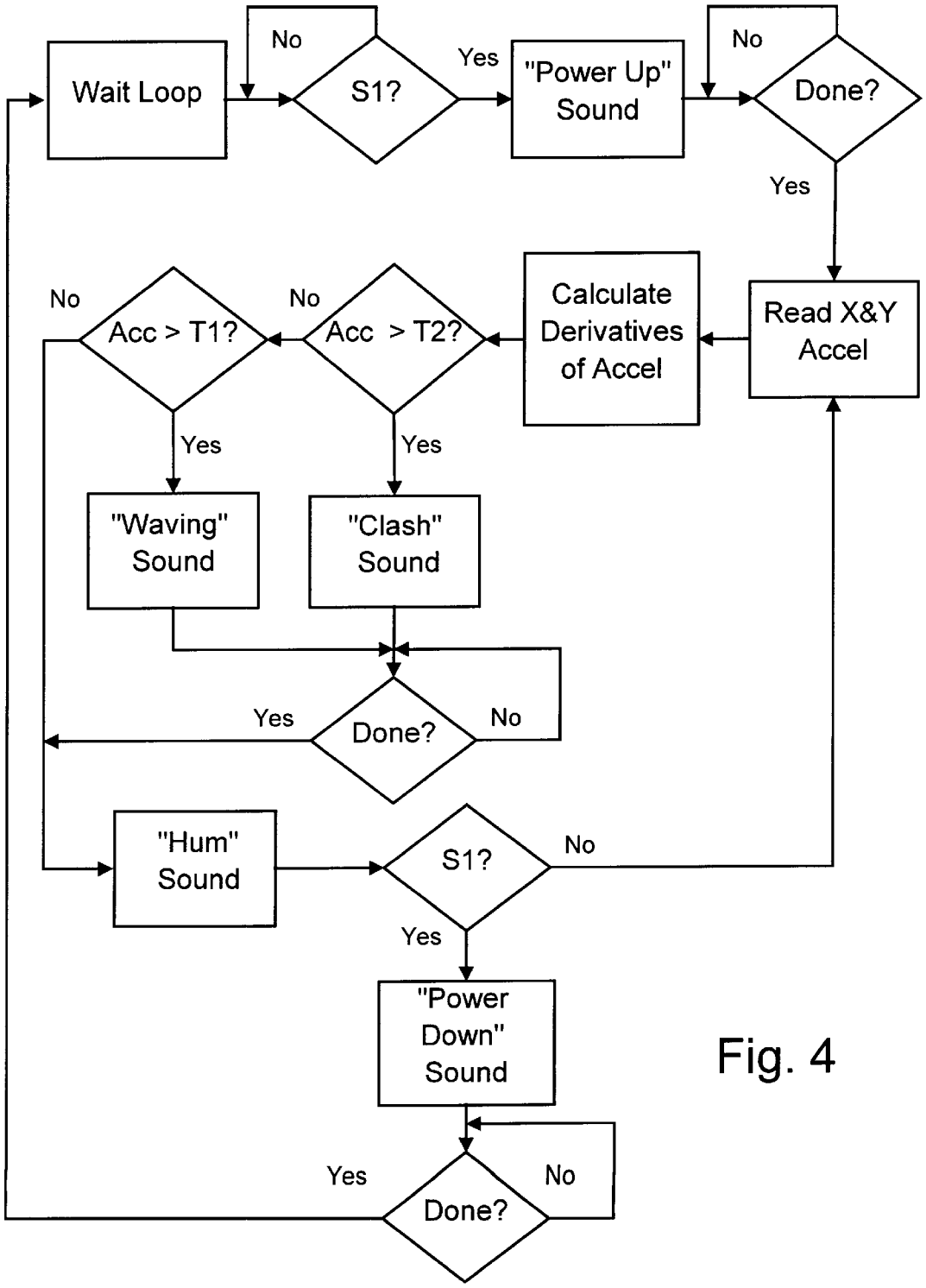

FIG. 4. is a flow chart which describes the program code employed in the preferred embodiment of the present invention.

Figure 5:
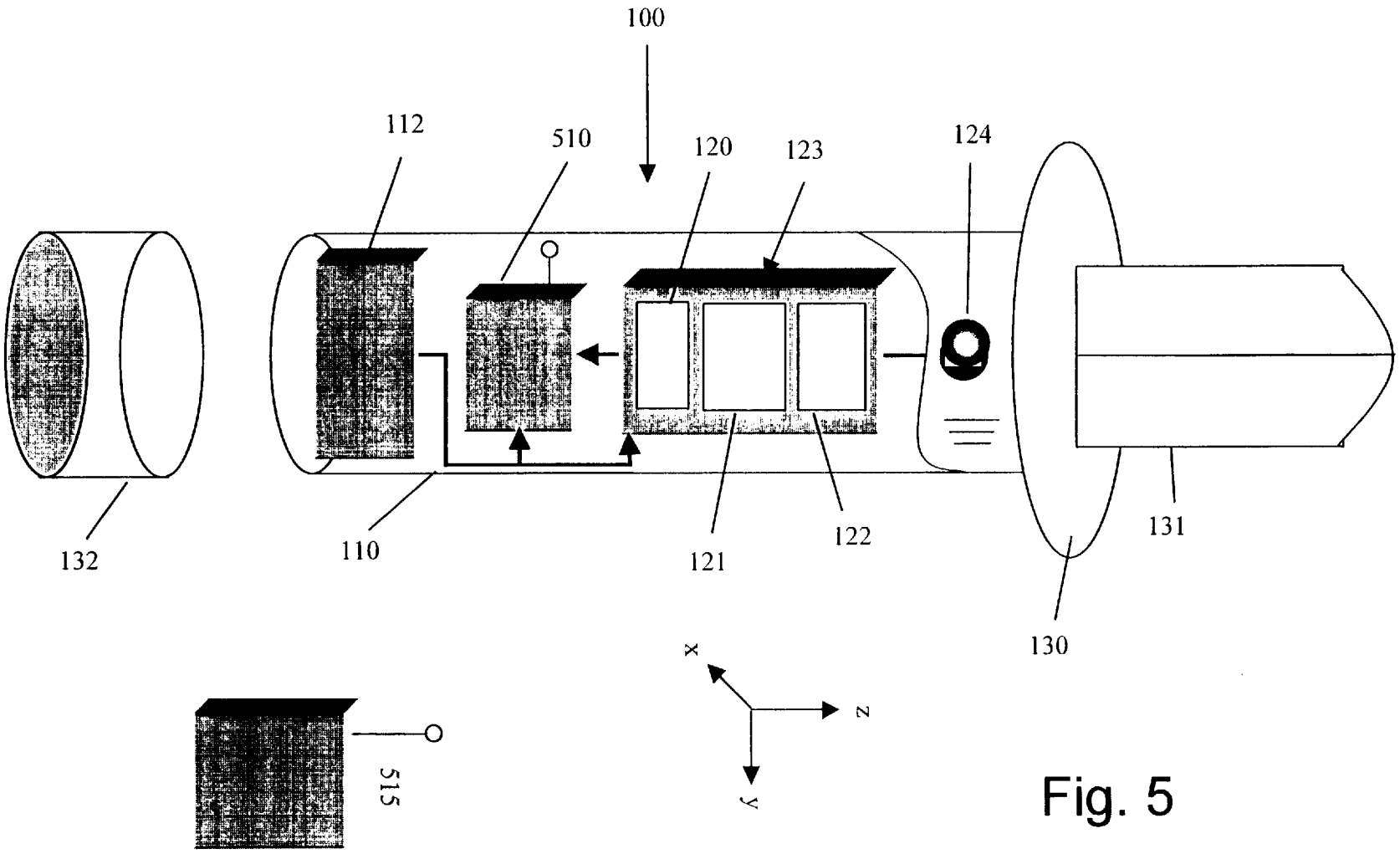

FIG. 5. is a partial sectional view of a second embodiment of the present invention.

Figure 6:
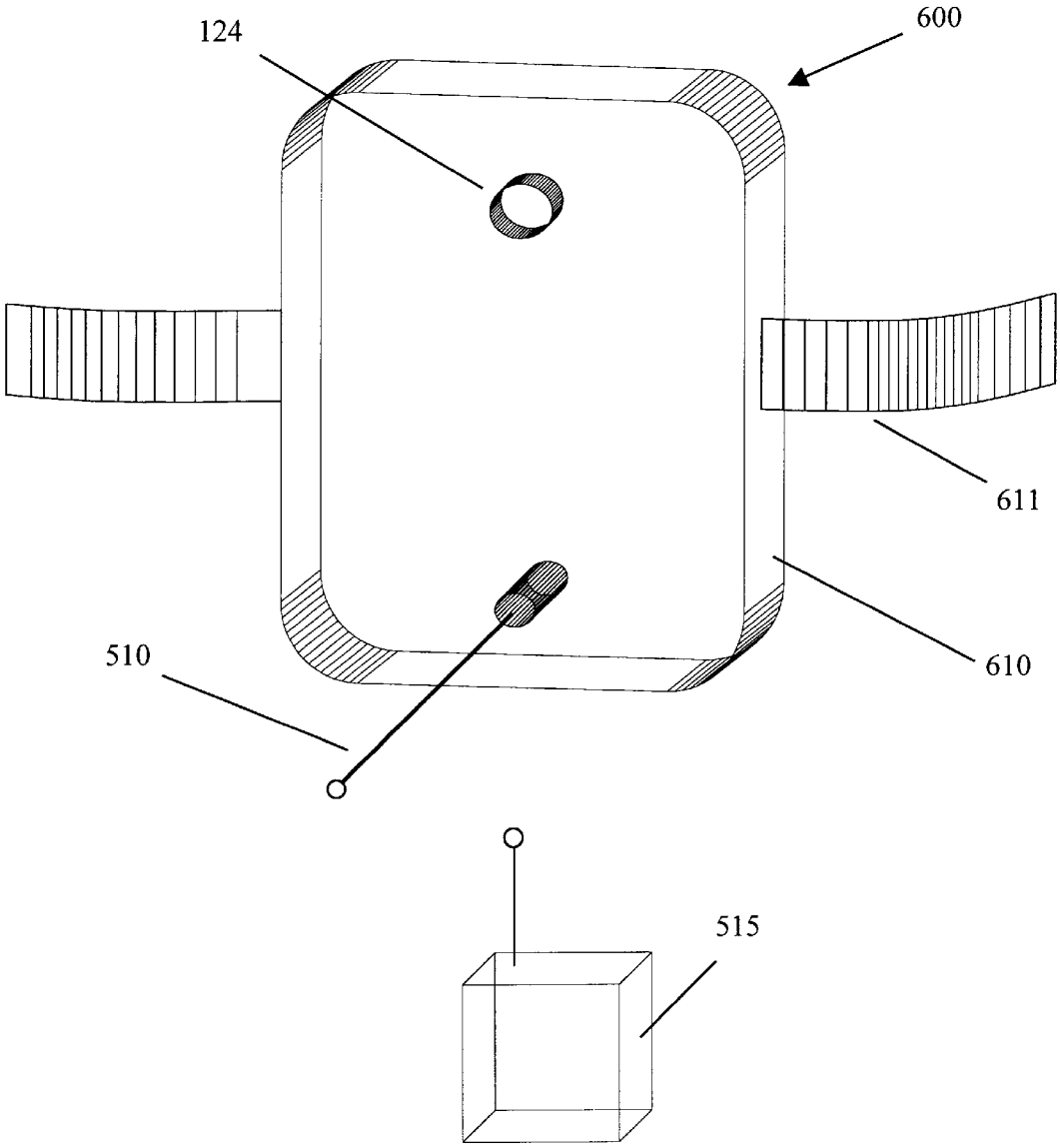

FIG. 6. is a perspective view of a third embodiment of the present invention.

The drawings constitute a part of this specification and include exemplary embodiments to the invention, which may be embodied in various forms. It is to be understood that in some instances various aspects of the invention may be shown exaggerated or enlarged to facilitate an understanding of the invention.

DESCRIPTION

FIGS. 1–4—Preferred Embodiment

Figure 1:
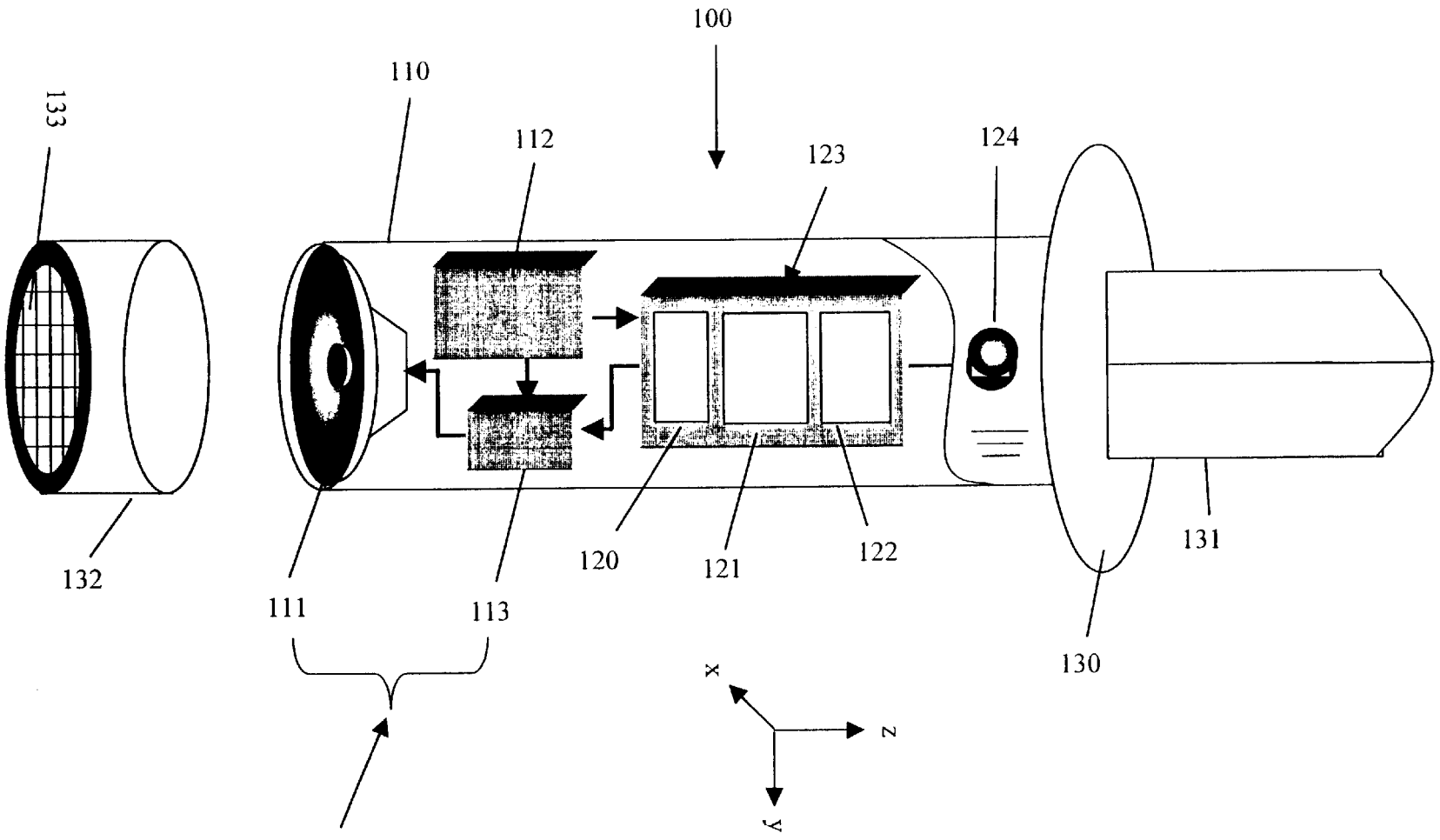
FIG. 1 is a partial sectional view of the first embodiment of the present invention.

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner. Referring now to FIG. 1, the amusement device of the present invention is generally designated as 100. Specifically, as a first embodiment of the present invention, a toy sword handle 110 is shown with a sword blade 131, a hilt guard 130, and a hilt cap 132. The handle 110, hilt guard 130, and hilt cap 132 are fabricated from plastic or metal. The blade 131 is made of plastic or other material that is known in the art to create a rigid, non-brittle, and safe blade for play. The blade 131 may also be semi-transparent or translucent and coated with a light-sensitive material in order to give it a glowing effect.

The electronic components of the present embodiment are encased in the handle 110. These electronic components comprise a motion-sensitive actuator 123, a playback 115, and a power supply 112.

The playback 115 includes an amplifier 113 and a speaker 111. The motion-sensitive actuator 123 is enabled and disabled via a button 124. Button 124 is a momentary pushbutton, slide switch, or other type of switch that has at least one pole. The motion-sensitive actuator is comprised of an accelerometer 122, a signal processor 121, and a storage 120. The accelerometer 122 converts any detected motion into an electrical signal. The resulting electrical signal from accelerometer 122 is transferred to the signal processor. The signal processor monitors the incoming motion data from the accelerometer and determines, via a predetermined algorithm, whether or not the detected motion meets a predefined criteria for playing a certain sound effect. This predefined criteria is pre-programmed into the signal processor and can be a simple or complex set of rules, equations, or logic that base their decision on the incoming motion detected by the accelerometer. As a simple example, the signal processor 121 can play one unique sound effect if it detects significant motion, such as waving, in the x direction, while another unique sound effect can be played if significant motion is detected in the y direction, respectively. As a consequence, different sound effects can be played as a function of the direction of the detected motion as well as the magnitude of the detected motion, a feature not present in the prior art.

A plurality of sound effects and program instructions for signal processor 121 are stored in the storage 120. In the present embodiment, the storage 120 consists of an EPROM chip. By re-programming the EPROM with different program instructions for signal processor 121, different motion-detecting algorithms can be implemented using a single realization of the present embodiment; yet another advantage over the prior art.

Again referring to FIG. 1 of the present embodiment, when signal processor 121 subsequently determines that the detected motion from the accelerometer meets the criteria for playing a particular sound effect, it sends out an analog signal representative of the chosen sound effect to the playback 115. The amplifier 113 receives the analog signal from the motion-sensitive actuator, amplifies the analog signal, and sends the amplified signal to the speaker 111 for auditory playback.

The motion-sensitive actuator and the playback are powered by the power supply 112, which is also encased in the handle 110.

The hilt cap 132 attaches to the end of the sword handle 110 and can have an open or closed bottom. In the present embodiment, the bottom of hilt cap 132 is open and is covered with a protective screen 133 to protect the speaker. The hilt cap in this embodiment will allow sound to emanate freely out of the handle from the speaker. The power supply is also replaceable by removing the hilt cap and the speaker from the sword handle.

Referring now to FIG. 2, a block diagram is shown of the motion-sensitive actuator 123 and the supporting components. The accelerometer 122 is a solid-state measurement device which converts dynamic and static accelerations into electrical signals that are directly proportional to acceleration. These electrical signals are sent to the signal processor 121 for analysis. The signal processor is comprised of a digital signal processor (DSP) 210, a master clock 211, and a digital-to-analog converter (DAC) 212. Alternatively, DSP 210 can be replaced with a standard microcontroller known in the art that is capable of analyzing data from the accelerometer. The master clock supplies DSP 210 with a synchronous clock to run program instructions which analyze the incoming signals from the accelerometer. The program instructions and prerecorded sound effects are both stored in the storage 120, which is comprised of an EPROM chip. The EPROM loads the data into the DSP upon applying power to the device.

While the button 124, denoted Si, stays in the "off" position, the DSP remains in an low-power mode to conserve battery life. When S1 is placed into the "on" position, the DSP begins running its internal program to analyze incoming signals from the accelerometer. Upon the DSP analyzing data and subsequently deciding that a sound effect is to be played based on the incoming motion measurements, it sends out digital sound effect samples representative of the selected sound effect to DAC 212.

The DAC is comprised of a digital-to-analog converter chip which converts these digital sound effects samples that are representative of the selected sound effect into an analog signal. This analog signal is then passed to the playback 115. The amplifier 113 boosts the analog signal representative of the selected sound effect and then sends the resulting amplified signal to the speaker 111. The speaker converts the analog signal into an audible sound indicative of the chosen sound effect, which the user can readily hear.

The power supply 112 powers the playback and motion-sensitive actuator. The power supply is comprised of a voltage regulator and replaceable battery capable of powering the motion-sensitive actuator and the playback.

Now turning to FIG. 3, a more detailed diagram of the components that comprise the motion-sensitive actuator and the power supply are shown. In the present embodiment, the signal processor is implemented by using off-the-shelf components. All of the components, data sheets, and relative connections for completing a necessary PCB board can be found by using an off-the-shelf DSP evaluation board, the ADDS-21xx ez-kit lite. The ADDS-21xx ez-kit lite is manufactured by Analog Devices, Inc., and is an evaluation DSP board that contains the DSP, the DAC, the EPROM, and the power supply. The ADDS-21xx ez-kit lite board is a standard prototyping tool that allows one skilled in the art to develop real-time DSP assembly code software. The software for the preferred embodiment of the invention was developed using this board.

The DSP is an Analog Devices ADSP-2181 operating at 33 MHz. The DSP has 16 k words of internal data RAM and 16 k words of internal program RAM. External master clock 211 runs at 16.67 MHz and is upconverted to 33 MHz in the DSP. The DAC is comprised of an Analog Devices AD1847 SoundPort running with an external DAC clock 310 at 24.576 MHz. The AD1847 has a programmable sampling frequency for its onboard ADC and DAC that is controlled via the DSP. The AD1847 is connected to the DSP via synchronous serial port 0, denoted SPORT0. The storage 120 is comprised of a 27C010 EPROM which is connected to the DSP via eight data lines and seventeen address lines. The data lines (D7–D0) of the EPROM are connected to eight data lines (D8–D15) of the DSP. The seventeen address lines of the EPROM are comprised of a combination of the fourteen address lines (A13–A0) and three data lines (D18–D16) of the DSP. Upon powerup, the DSP sets the /BMS line low and loads in the data and program instructions from the EPROM into its own internal memory. After loading is complete, the DSP jumps to the beginning line of program code and begins program execution.

The accelerometer 122 is an Analog Devices ADXL202+/−2 g dual axis digital output accelerometer chip. This accelerometer is different than any motion actuator used in the prior art in the fact that it measures precise acceleration in two coordinate axes, which is used by the DSP to classify different types of movement, such as waving versus striking, jabbing versus blocking, and the like. The ADXL202 also outputs a pulse-width modulated digital signal that is proportional to the acceleration experienced by the chip in each respective axis. It is able to measure static acceleration, such as gravity, and also dynamic accelerations for each axis. The digital signals outputted by the ADXL202, XOUT and YOUT, are connected to the DSP via external port pins PF0 and PF1, respectively. The x-axis output is connected to the PF0 port pin, and the y-axis output is connected to the PF1 port pin on the DSP. Thus, the DSP is responsible for polling the port pins and decoding the pulse-width modulated digital signal via a software decoding routine. This novel approach eliminates the need for a dual-channel ADC that would typically be needed to convert analog acceleration signals into digital values for the DSP.

The button 124 is connected to the external interrupt line /IRQE on the DSP and debounced via resistor R and capacitor C. Any type of debouncing circuit known in the art can be used in conjunction with the button to provide a clean signal to /IRQE. Every time the button is pressed, the /IRQE line is pulled low, and the program running internally on the DSP responds by jumping to the appropriate /IRQE interrupt subroutine, in which the DSP then enables or disables itself, depending on its previous state, in order to monitor incoming acceleration data from the accelerometer. The power supply 112, also shown in FIG. 3, is comprised of a nine-volt battery 320 and a five-volt regulator LM7405 321. The five-volt regulator also resides on the ADDS-2181 ez-kit lite DSP board, and the only external component supplied is the nine-volt battery.

In accordance with an important feature of the present invention, there is shown in FIG. 4 a flowchart of the program code that is contained in EPROM 120 and executed by DSP 210. The program monitors the motion data from the accelerometer 122 and determines whether a sound effect should be played in accordance with a predetermined set of rules. The software flowchart in FIG. 4 is described in connection with the present embodiment, it is not intended to limit the scope of the alternative programs, methods, and techniques that are contained within the spirit of the present invention.

Referring now to FIG. 4, when power is applied to the device, the DSP loads the program code from the EPROM into its own internal memory, then jumps to the starting program code segment and begins running the program internally. At the beginning of the program, the DSP initializes all relevant variables and sits in a "wait" loop until button S1 is placed into the "on" position. When button S1 is pressed in this manner, the signal processor reacts by sending out a "power up" sound effect to the playback. This gives the user the realism that the toy sword has been "activated" and has come to life. The signal processor waits until the sound has been completely played, and afterwards it begins to monitor acceleration measurements delivered by the accelerometer. The DSP decodes the incoming acceleration digital data in the x and y axes, respectively. Once it receives a valid acceleration measurement for each axis direction, the derivative of acceleration in each direction is calculated. By computing the derivative of acceleration, it can be determined how vigorously the sword is being waved in each of the accelerometer axes. Furthermore, since the accelerometer is capable of measuring static acceleration, by computing the derivative this static acceleration is removed, and the resulting measurement only contains the acceleration components due to dynamic motion, such as waving, striking, and the like.

The derivative measurements are then compared next to two thresholds, a high (T2) and low (T1) threshold for both the x and y axes. If either of these axis measurements surpasses the T1 threshold, then there is a significant dynamic acceleration typical of the user waving the sword handle around. Thus, a "waving" sound effect is played. The waving sound effects are unique to the x and y axes, respectively. That is, if T1 is surpassed in the x direction only, one type of waving sound effect is played. If T1 is surpassed in the y direction only, another type of waving sound effect is played. If T1 is surpassed in both directions, then yet another type of waving sound effect is played, for example, the two unique waving sound effects for both axes can be added together by the DSP before sent to the playback. In a similar manner, if either axis derivative measurement surpasses the T2 threshold, then this is indicative of a large dynamic acceleration, typical of sudden stops of the sword handle or the sword blade striking another object. Thus, if either of the axis derivative measurements surpasses T2, then a corresponding "clashing" sound is played in accordance with the rules set forth above and as shown in FIG. 4. If the measurements do not surpass any of the thresholds, then no "waving" or "clashing" sounds are played since the detected motion is considered minimal.

While the sword is "on", the DSP also plays out a constant "hum" sound. This gives the user the added realism that the toy sword is "active". The hum can be an ambient energy hum or similar sound effect, an example being the sound emanated from an activated lightsaber in the popular Star Wars movies. The hum sound effect is mixed in real time with any other sound effect currently being played out by the DSP, as set by the flowchart in FIG. 4. So, if there is no "waving" or "clashing" sound effects playing, then the user will only hear the "hum" sound effect while the sword is on. If a "waving" or "clashing" sound effect is presently being played, the "hum" sound effect is mixed with the currently outputted sound effect. After mixing the sound effects together, the DSP sends out the resulting mixed sound to the playback.

At the end of the main program loop, the program checks to see whether button S1 has been pressed again. If button S1 has not been pressed, the program continues monitoring acceleration data from the accelerometer and playing out sound effects based on the flowchart shown in FIG. 4. If button S1 has been pressed again, this is indicative of "deactivating" the sword. In this case, the DSP sends out a "power down" sound effect to the playback, which gives the user the added realism that the sword is now turned off. After the entire "power down" sound effect is played, the DSP returns to a power-down mode and again waits for button S1 to be pressed. In this state, no sound effects are played out and the program once again waits for button S1 to be turned on.

Table 1 contains program instructions in object code for the storage 120 on the ADDS-21xx ez-kit lite kit. The object code is listed in S-record format. The program implements the spirit of the algorithm specified in FIG. 4., with the acceleration measurements on the PF1 port pin decoded exclusively, corresponding to y-axis acceleration measurements. The sound effects for each event as specified in FIG. 4 can be chosen to correlate the specific movements to each unique sound effect outputted.

While the program flowchart shown in FIG. 4 and object code shown in Table 1 is representative of the preferred embodiment, anyone skilled in the art will recognize that many other motion-based algorithms can be readily implemented by writing new software for the DSP and storing the program into the storage. Since the storage also stores the predetermined sound effects, these sound effects can be changed as well to suit the specific application. This process requires no changes to the hardware described above and results in a programmable motion-sensitive sound effects device.

FIG. 5—Second Embodiment

Referring now to FIG. 5, a second embodiment of the present invention is shown. In this embodiment of the invention, the playback 115 is replaced by a transmitter 510. The transmitter is a device that is encased within the sword handle 110 and transmits the analog signal received from the motion-sensitive actuator to a remote receiver 515. In this embodiment of the invention, the amplifier and speaker are no longer necessary and can be eliminated from the handle. Likewise, the power supply supplies the necessary power to the transmitter. The transmitter uses a signal from a family of signals comprised of radio frequency signals, ultrasonic signals, or infrared signals. The receiver is comprised of components that are capable of decoding the signal emanated by the transmitter, amplifying the decoded signal, and audibly emitting the decoded and amplified signal. The decoded signal is an analog signal representative of the selected sound effect. As an example, the transmitter 510 is encased in the handle and is a typical FM transmitter known in the art. The remote receiver 515 is a typical FM radio receiver, which effectively gives the user a wireless link between the toy sword and the remote radio receiver.

FIG. 6—Third Embodiment

A third embodiment of the present invention is demonstrated in FIG. 6. This embodiment is comprised of a body-worn sound effects unit 600 which is attached to the user's body and can be used with existing toys or props. The body-worn unit is comprised of a housing 610 and a band 611. The band is designed for the wrist or ankle and is attached to the housing. The band allows the user to wear the housing comfortably. The electronics in the body-worn unit are comprised of the same components as the second embodiment and operates in the same manner as the second embodiment. However, in this embodiment, the difference is that the user wears the body-worn sound effects unit which can be used in conjunction with any toy, game, doll, and the like. As the user moves in a predefined manner, the body-worn unit senses the motion and plays out unique sound effects as a function of the user's movements. Like the second embodiment, the sound effects based on the user's motion are transmitted by the transmitter to a remote receiver. This embodiment is advantageous to the user that has a plurality of toys, games, dolls, and the like that do not have sound effects capability, but would like to add sound effects capability to those toys, games dolls, and the like by using this one device. This embodiment adds further realism and provides an interactive environment in which the user can play with a plurality of preexisting toys, games, dolls, and the like.

Operation

The manner of using the illustrated embodiments are the same. When the button is pushed once so that it is placed into the "on" position, the motion-sensitive actuator is enabled. The device plays an "activation" sound effect, giving the realism that the device has become active. Also, a constant "hum" or other relevant sound effect is sent to the playback indicating to the user that the device is "active". Subsequently, when the device is waved about in either the x-direction or y-direction, the resulting motion is detected by the motion-sensitive actuator. The motion-sensitive actuator analyzes the motion, and based on its internal motion-detection algorithm, it decides whether or not the resulting motion satisfies its requirements. If the motion does satisfy the requirements, the motion-sensitive actuator sends a unique sound effect that is representative of the detected motion to the playback. The playback audibly emits a signal indicative of the selected sound effect for the user to hear. As the user moves the device around, the device will continue to play out the motion-based sound effects until the button is pressed once more. Upon pressing the button, the constant "hum" sound is stopped and a "deactivating" sound effect is played, giving the added realism that the device in now inactive. In this mode, the motion-sensitive actuator is disabled and no sound effects are played. The motion-sensitive actuator then waits until the button is pressed again, and the program cycle is repeated.

Conclusion, Ramifications, and Scope of Invention

Accordingly, the reader will see that the motion-sensitive sound effects device of this invention provides a programmable, portable, and interactive sound effects solution that can be designed into new toys or used with preexisting toys, providing a more realistic and fulfilling play environment for the user.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims and their legal equivalents.

TABLE 1

S22500000040060093FE2040020093FE1040000093FE3040087093FE403C008C0000003C0083EF
S225000021028000180 20F0000000000000000000000000000000000000000000000000000000000F
S22500004200000000000000000000000000000000000000000A001F000000000000000000000401F50C0
S22500006393FE2040004093FE1040001093FE3040019093FE40028000000000000000000000070
S22500008400000000000000000000000000000000000000000000000000000000000000000000056
S2250000A500000000000000000000000000000000000000000000000000000000000000000000035
S2250000C600000000000000000000000000000000000000000000000000000000000000000000014
S2250000E700000000000000000000000000000000000000000000000000000000000000000000F3
S22500010800000000000000000000000000000000000000000000000000000000000000000000D1
S22500012900000000000000000000000000000040227093FE2040000093FE1040008093FE30CB
S22500014A4022E093FE400280000000000000000000000000000000000000000000000000000FA
S22500016B000000000000000000000000000000000000000000000000000000000000000000006E
S22500018C000000000000000000000000000000000000000000000000000000000000000000004D
S2250001AD000000000000000000000000000000000000000000000000000000000000000000002C
S2250001CE000000000000000000000000000000000000000000000000000000000000000000000B
S2250001EF0000000000000C00000000000FFFFFFFFFFFFFFFFFFFFFFFFFFFFFFFFFFFC000C1BB
S22500021000C288C388C488C588C680C780C853C909CA00CC40CD0018030F0A001F0A001F0AF7
S225000231001F0A001F0A001F0A001F0A001F0A001F0A001F0A001F0A001F0A001F0A001F0AE4
S225000252001F0A001F80003A227A0F0A001018078F180B0F0A001F0A001F0A001F18148F0A9F
S225000273001F0A001F0A001F0A001F0A001F0A001F0A001F0A001F0A001F0A001F0A001F0AA2
S225000294001F0A001F0A001F0A001F0A001F0A001F0A001F0A001F0A001F0A001F0A001F0A81
S2250002B5001F40800093FFF034000234003A34004334003B3801013800D902020F47B0009350
S2250002D6FE600000000000000000000000000340016380015407 2B093FF3040000093FF404097
S2250002F7000093FF504860F093FF6040007093FF7040007093FF9040007093FF9040007093EC
S225000318FFA040000093FFE041800093FFF03C0FFC0000003C00243C0401400010900030042F
S22500033900603C040360000E0D0C9080003026780F1805F140002480000023800F1806308015
S22500035A000023800F1806610280004BF3F480016023800F90004A02800080017023800F9076
S22500037B004A0280003C0FFC0000001C084F3C0303180ACF0C0030700005900040 0D020140D2
S22500039C010422E00F0A00124AF0009000404000009000300A001F4000009000E09000809086
S2250003BD00909000A09000B09000C09000D09000E09000F09001D09001E09001F09002009005
S2250003DE021090022040000090023090024090025040000090026090027090028040001090 59
S2250003FF02909002B04000009002C09002D03802E238000A380006382801380649380015 40FF
S2250004200000916 6A002020F0A000F0280000000000000000180ACF0C00308002D022780F1841
S2250004410D901C1EFF1C1C9F80022022780F180C6080024122611F90024A40001522EA0F1850
S2250004620C848002C022780F180DC11C166F400000900240180DCF4000090024080021022A6
S225000483780F180D9080023122611F90023A40008522EA0F180DC48002C022780F180DC11C40
S2250004A4172F40000090023002010F180DCF400000900230180DCF8002D022780F180FD038C4
S2250004C500058002502260 1F90025A40002422E20F180EB3380015090015380005400010 90D5
S2250004E6025050001580025040001423C00F180F3040002423C00F180F70400FF423810F0FD8
S2250005071208180FAF4FF00423810F0F12000D00AE0F32FF0D001E8002C022780F1810D01CC2
S22500052810FF80028422000F0F32FF0D004E22790F0F32F40D001E38280122610F1810CF0DCB
S22500054900A190006A90005A0A001F3800068002602260 1F90026A40002422E20F1812638895
S22500056A029609001A380006400010900260800270226 01F90027A8002A422E20F181263408B
S22500058B000090027090026090 02C00A000F8002B022780F1812B150001A1812CF70001A80C8
S2250005AC029040001423C00F181370800260400014 23C00F18143040002423C00F1813E08051
S2250005CD026040001423C00F1813E040002423C00F181430400FF423810F0F120890028E0A5A
S2250005EE000F4FF00423810F0F120090028E0A000F4000109002C0400000900270800 2D02230
S22500060F780F1815D04FFFF09002904000109002B04000A09002A04002E04000A422600F0D99
S225000630082A4000009002D002020F0A001F4000109002909002B09002D04000A09002A03834
S22500065102E202030F0A001F4000109002C04000009002703A32F2400010900290400009 0DE
S22500067202B0408ED09002A00A000F4000109002C0400000900270400058156A022601F0D79
S225000693000A4000C426E00F2208009156AA8156A140001523C90F181A1040002523C90F18E1
S2250006B41A9040003523C90F181B1040004523C90F181B9040005523C90F181C1040006523E4
S2250006D5C90F181B9040007523C90F181A1040008523C90F181B1040009523C90F181B90409C
S2250006F600A523C90F181A904000B523C90F181A10181C1F380382400010900290400010 90E8
S22500071702B040B2109002A00A000F382E4240001090029040000 09002B040BB009002A00AEA
S225000738000F38E9424000109002904000009002B040CA509002A00A000F39B3924000109032
S2250007590290400009002B0407F609002A00A000F38B5924000109002904000109002B04039
S22500077AA1109002A00A000F8001D022780F0A00004000009001D08000A08001F422E00F23EF
S22500079BE20F8002010D005A22E90F4400034800070D00250D006A20810F21880F0D001C90E3
S2250007BC020C40003522E90F181E8340001090021040 00A522E90F181EA340001090022018DD
S2250007DD1ECF4000009002104000009002208000A09001F00A000F8000C022780F1820618376
S2250007FEFE5040002423800F0F12FF8000E50D001E9000F18000D022601F9000DA400024225F
S22500081FE20F1822B44000309000D022E90F1822B34000109000C00A000F83FE5040002423EC
S225000840800F0F12FF8000E50D001E9000F18001E022780F18218122790F18216080008022A9
S225000861601F90008A1822BF4000109001E022E90F1821E280009022601F90009A1822BF8095
S2250008820080800094900 0A022600F9000BA4000109001D0400009000909000809000C090B0
S2250008A300D09001E08000F09000E00A000FFFFFFFFFFFFFFFFFFFFFFFFFFFFFFFFFFFFFFFF08
S9030000FC

What is claimed is:

1. A programmable motion-sensitive sound effects device comprising:

a motion-sensitive actuator for selecting a sound effect in response to a sensed motion of the device and producing a sensed motion signal indicative of the selected sound effect, the motion-sensitive actuator including:

(a) an accelerometer measuring an acceleration of the sensed motion in each of two coordinate axes and outputting a digital signals proportional to the acceleration in each of the two coordinate axes; and (b) a signal processor receiving the accelerometer digital signals, calculating a numerical value that is a function of the acceleration in each of the two coordinate value axes and selecting a sound effect based on the calculated numerical values and;

a playback for receiving a playback signal resulting from said sensed motion signal from said motion-sensitive actuator and emitting an audible sound in response to said playback signal.

2. The programmable motion-sensitive sound effects device as claimed in claim 1 wherein said motion-sensitive actuator further comprises a sound effect storage for storing at least one predetermined sound effect and wherein the function of the acceleration used to calculate the numerical values is a derivative of the acceleration in each of the coordinate axes.

3. The programmable motion-sensitive sound effects device as claimed in claim 2 wherein said signal processor comprises:

a selected one of a digital signal processor and a microcontroller for analyzing said accelerometer digital signals, a memory storage for storing program instructions, and;

a digital-to-analog converter for retrieving said stored sound effect and converting said stored sound effect into said playback signal for said playback.

4. The programmable motion-sensitive sound effects device as claimed in claim 2 wherein said sound effect storage comprises a memory chip for storing a plurality of predetermined sound effects.

5. The programmable motion-sensitive sound effects device as claimed in claim 2 further comprising:

a power supply for providing voltage to said signal processor and said memory storage and said playback.

6. The programmable motion-sensitive sound effects device as claimed in claim 1 wherein said playback comprises an amplifier and a speaker.

7. The programmable motion-sensitive sound effects device as claimed in claim 1 wherein said device is used with a unit chosen from a family of units comprising toys, dolls, figurines, games and books.

8. The programmable motion-sensitive sound effects device of claim 1 wherein the digital signals output by the accelerometer are pulse-width modulated digital signals.

9. A programmable motion-sensitive sound effects device comprising:

a motion-sensitive actuator for selecting a sound effect in response to a sensed motion of the device and producing a sensed motion signal indicative of the selected sound effect, the motion-sensitive actuator including:

(a) an accelerometer measuring an acceleration of the sensed motion in each of two coordinate axes and outputting digital signals proportional to the acceleration in each of the two coordinate axes; and (b) a signal processor receiving the accelerometer digital signals, calculating a numerical value that is a function of the acceleration in each of the two coordinate value axes and selecting a sound effect based on the calculated numerical values and;

a playback mechanism for receiving a playback signal resulting from said sensed motion signal from said motion-sensitive actuator and transmitting said playback signal to a receiver.

10. The programmable motion-sensitive sound effects device as claimed in claim 9 wherein said motion-sensitive actuator further comprises a sound effect storage for storing at least one predetermined sound effect and wherein the function of the acceleration used to calculate the numerical values is a derivative of the acceleration in each of the coordinate axes.

11. The programmable motion-sensitive sound effects device as claimed in claim 10 wherein said signal processor comprises:

a selected one of a digital signal processor and a microcontroller for analyzing said accelerometer digital signals, a memory storage for storing program instructions, and;

a digital-to-analog converter for retrieving said stored sound effect and converting said stored sound effect into said playback signal for said playback.

12. The programmable motion-sensitive sound effects device as claimed in claim 10 wherein said sound effect storage comprises a memory chip for storing a plurality of predetermined sound effects.

13. The programmable motion-sensitive sound effects device as claimed in claim 10 further comprising:

a power supply for providing voltage to said signal processor and said memory storage and said transmitter.

14. The programmable motion-sensitive sound effects device as claimed in claim 9 wherein said playback comprises a transmitter for converting said playback signal that is indicative of said sound effect into a transmission signal that is to be transmitted in the direction of said receiver.

15. The programmable motion-sensitive sound effects device as claimed in claim 14 wherein said transmitter is selected from a family of signals comprising radio frequency signals, ultrasonic signals, and infrared signals.

16. The programmable motion-sensitive sound effects device as claimed in claim 9 wherein said device is used with a unit chosen from a family of units comprising dolls, figurines, toys, games and books.

17. The programmable motion-sensitive sound effects device of claim 9 wherein the digital signals output by the accelerometer are pulse-width modulated digital signals.

18. A toy including a programmable sound effects device which utilizes a motion-sensitive mechanism for selecting different sound effects depending on a motion of the toy, the toy comprising:

a) an electronic motion-sensitive actuator including a signal processing unit for analyzing motion of the toy and producing a sensed motion signal indicative of a selected sound effect, the motion-sensitive actuator including:

(1) an accelerometer measuring an acceleration of sensed motion in each of two coordinate axes and outputting digital signals proportional to the acceleration in each of the two coordinate axes; and (2) a signal processor receiving the accelerometer digital signals, calculating a numerical value that is a function of the acceleration in each of the two coordinate value axes and selecting a sound effect based on the calculated numerical values;

b) a sound effect storage media connected to the actuator for storing a plurality of predetermined sound effects and providing outputs in response to the sensed motion signal from the actuator;

c) a digital-to-analog converter for producing analog signals in response to said sensed motion signal from the actuator and said outputs; and, d) a playback mechanism connected to the converter and comprised of an amplifier and speaker for emitting sound effects in response to said analog signals.

19. A motion responsive sound effects device for use with a toy comprising:

a) an accelerometer for sensing motion and emitting outputs reflective of sensed motion in both x & y coordinate axes;

b) a storage component containing program instructions and prerecorded sound effects;

c) a clock-controlled digital signal processor connected to the accelerometer and the storage component for emitting digital signals in response to said accelerometer outputs and outputs from the storage component, the signal processor receiving the accelerometer outputs, calculating a numerical value that is a function of the acceleration in each of the x & y coordinate axes and selecting one or more sound effects based on the calculated numerical values, the emitted digital signals representative of the one or more selected sound effects;

d) a digital-to-analog converter connected to the processor for converting the digital signals to analog signals;

e) an amplifier connected to the converter for amplifying the analog signals;

f) a speaker for emitting sounds in response to the amplified signals; and, g) a power supply connected to a selected one of the accelerometer, the component, the processor, the converter and the amplifier for powering the device.

20. The motion responsive sound effects device of claim 19 wherein the function of the acceleration used to calculate the numerical values is a derivative of the acceleration in each of the coordinate axes.

* * * * *